US007999781B2

(12) United States Patent
Inada

(10) Patent No.: US 7,999,781 B2
(45) Date of Patent: Aug. 16, 2011

(54) LIQUID CRYSTAL DISPLAY DEVICE, DRIVING DEVICE, DISPLAY CONTROL DEVICE, AND METHOD OF DRIVING AT A FREQUENCY HIGHER THAN AN AUDIBLE FREQUENCY BAND FOR A HUMAN BEING HAVING A DRIVE PERIOD AND DRIVE SUSPENSION PERIOD

(75) Inventor: Ken Inada, Northway Headington (GB)

(73) Assignee: Sharp Kabushiki Kaisha, Osaka (JP)

( * ) Notice: Subject to any disclaimer, the term of this patent is extended or adjusted under 35 U.S.C. 154(b) by 1091 days.

(21) Appl. No.: 11/059,349

(22) Filed: Feb. 17, 2005

(65) Prior Publication Data

US 2005/0179633 A1 Aug. 18, 2005

(30) Foreign Application Priority Data

Feb. 18, 2004 (JP) ..... 2004-042014

(51) Int. Cl.
*G09G 3/36* (2006.01)

(52) U.S. Cl. ..... 345/99

(58) Field of Classification Search ..... 345/87, 345/173, 99

See application file for complete search history.

(56) References Cited

U.S. PATENT DOCUMENTS

| | | | | |
|---|---|---|---|---|
| 5,200,846 | A | 4/1993 | Hiroki et al. | |
| 5,376,944 | A | 12/1994 | Mogi et al. | |
| 5,900,857 | A * | 5/1999 | Kuwata et al. | 345/100 |
| 6,061,103 | A * | 5/2000 | Okamura et al. | 348/767 |
| 6,271,818 | B1 * | 8/2001 | Yamazaki et al. | 345/92 |
| 6,392,620 | B1 * | 5/2002 | Mizutani et al. | 345/88 |
| 6,795,066 | B2 * | 9/2004 | Tanaka et al. | 345/204 |
| 2002/0047555 | A1 | 4/2002 | Inukai | |
| 2002/0180673 | A1 | 12/2002 | Tsuda et al. | |
| 2003/0045043 | A1 | 3/2003 | Koyama | |
| 2003/0080951 | A1 * | 5/2003 | Fujiwara et al. | 345/204 |
| 2003/0146712 | A1 | 8/2003 | Inukai | |
| 2004/0012581 | A1 | 1/2004 | Kurokawa et al. | |
| 2004/0217952 | A1 | 11/2004 | Koyama | |
| 2005/0140632 | A1 | 6/2005 | Tsuda et al. | |
| 2006/0055633 | A1 | 3/2006 | Koyama | |
| 2007/0176880 | A1 | 8/2007 | Kurokawa et al. | |

FOREIGN PATENT DOCUMENTS

| | | |
|---|---|---|
| JP | 06-111988 | 4/1994 |
| JP | 08-179285 A | 7/1996 |
| JP | 08-211851 | 8/1996 |
| JP | 2676092 | 7/1997 |
| JP | 09-329807 | 12/1997 |
| JP | 2002-055660 | 2/2002 |
| JP | 2002-132224 | 5/2002 |
| JP | 2004-29540 | 1/2004 |
| WO | WO 03/063126 | 7/2003 |

* cited by examiner

*Primary Examiner* — Chanh Nguyen
*Assistant Examiner* — Ram A Mistry
(74) *Attorney, Agent, or Firm* — Harness, Dickey & Pierce, P.L.C.

(57) ABSTRACT

In a driving method for driving a liquid crystal display device, each of frame periods is divided into a drive period in which a counter electrode is driven, and a drive suspension period in which the counter electrode is not driven. During the drive period, a data signal is outputted to a video signal line driving circuit at a frequency corresponding to a driving frequency for driving the counter electrode. During the drive suspension period, the outputting of the data signal is stopped. Thus, there are provided a liquid crystal display device and a driving method therefor, in which user aggravating sound is prevented without increasing power consumption.

6 Claims, 12 Drawing Sheets

LIQUID CRYSTAL DISPLAY DEVICE, DRIVING DEVICE, DISPLAY CONTROL DEVICE, AND METHOD OF DRIVING AT A FREQUENCY HIGHER THAN AN AUDIBLE FREQUENCY BAND FOR A HUMAN BEING HAVING A DRIVE PERIOD AND DRIVE SUSPENSION PERIOD

This Nonprovisional application claims priority under 35 U.S.C. §119(a) on Patent Application No. 42014/2004 filed in Japan on Feb. 18, 2004, the entire contents of which are hereby incorporated by reference.

FIELD OF THE INVENTION

The present invention relates to an active matrix liquid crystal display device having a display section in which a liquid crystal layer is interposed between a pixel electrode and a counter electrode facing each other, and a driving method for driving such a liquid crystal display device. The present invention also relates to a driving device and a display control device for use in the liquid crystal display device.

BACKGROUND OF THE INVENTION

Conventionally, an active matrix liquid crystal display device (Hereinafter referred to as LCD device) which adopts a TFT (Thin Film Transistor) or the like has been widely known. Such an LCD device, as shown in FIG. 11, includes a liquid crystal panel 51 in which liquid crystal 54 is interposed between a TFT-side glass substrate 52 and CF (Color Filter)-side glass substrate 53 so arranged as to face each other. The liquid crystal panel 51 is compartmentalized by scan signal lines and video signal lines, forming liquid crystal cells (pixels) arranged in a matrix manner, and an image is displayed on the liquid crystal panel 51 by controlling an alignment direction of liquid crystal molecules on a cell-by-cell basis for the respective liquid crystal cells.

The alignment direction of the liquid crystal molecules in the liquid crystal cell is controlled by (i) a voltage impressed to a counter electrode formed on a surface of the CF-side glass substrate 53, and (ii) a voltage impressed, by an ON/OFF of the TFT in each of the liquid crystal cells, to a pixel electrode on the TFT-side glass substrate 52.

Generally, in order to ensure reliability of the liquid crystal material, the LCD device is driven by inverting polarity of the voltage being impressed to the liquid crystal of the respective pixels, at a predetermined interval (i.e. an alternate current driving). Examples of such an alternate current driving method for the LCD device are a line-inversion method, a source-inversion method, and a dot-inversion method. In the line-inversion method, image signals are impressed to each liquid crystal cell by inverting the polarity on a line-by-line basis. For example, as shown in FIG. 12, in the line-inversion method, the polarity of the voltage impressed to the liquid cell is inverted by changing, every 1 horizontal (1H) period, (i) the voltage impressed to the counter electrode (solid line) and (ii) the voltage impressed to the liquid crystal cell (dotted line), the voltage corresponding to an image signal.

As described, a state of the liquid crystal while the alternate current driving is carried out is similar to a state of an electrostatic speaker. More specifically, as shown in FIG. 13, in the electrostatic speaker, a conductive thin film is provided between a pair of net-like fixed electrodes. Each of the net-like electrodes respectively receives signals whose phases are opposite to each other, and a sound is produced by impressing a voltage (bias) to the conductive thin film, thus causing the conductive film to vibrate. Similarly, while the liquid crystal is driven by alternate current driving, a pair of electrodes, i.e. counter electrode and pixel electrode, respectively receive a signals whose phases are opposite to each other. The voltage (bias) is impressed to these electrodes.

Accordingly, by driving the LCD device using the line-inverting method, the CF glass substrate 53 vibrates in accordance with the impression of the voltage to the counter electrode, i.e. in accordance with the driving of the counter electrode. Driving frequency of the counter electrode is about 10 kHz in a typical liquid crystal panel for use in typical mobile phones. This causes the CF glass substrate 53 to vibrate at about 10 kHz, while the LCD device is being driven. Since a frequency of the vibration is within an audible frequency band for human being, a user-aggravating sound (noise) is produced while the LCD device is being driven.

For example, in order to reduce the noise generated in the LCD device, Japanese Unexamined Patent Publication No. 8-179285/1996 (Tokukaihei 8-179285; published on Jul. 12, 1996) suggests that the driving frequency of the counter electrode be made higher than an audible frequency band for human being, and that the vibration be attenuated by providing a damping material in the liquid crystal display element.

However, the foregoing method disclosed in Japanese Unexamined Patent Publication, in which the driving frequency of the counter electrode is increased, the driving frequency of the counter electrode is simply increased in a conventional driving method for driving an LCD device, so that the noise is reduced. Simply increasing the driving frequency of the counter electrode causes not only deterioration in operation characteristics of the LC panel, but also an increase in power consumption. Consequently, it becomes difficult to reduce the power consumption in the LCD device.

Further, a provision of the damping material in a liquid crystal display element complicates a configuration of the LCD device. Further, a step for providing the damping material becomes necessary in a process for manufacturing of the LCD device, thus the process for manufacturing the LCD device will become complicated.

SUMMARY OF THE INVENTION

In view of the foregoing problems, the present invention is made, and an object of the present invention is to provide a liquid crystal display device in which production of noise is reduced without increasing an amount of current consumed, and to provide a driving method for driving such a liquid crystal display device, and a driving device and a display control device for carrying out the method.

In order to achieve the foregoing object, a driving method of the present invention for driving a liquid crystal display device for sequentially displaying frames of an image on a display section including (A) scanning signal lines, (B) video signal lines, (C) pixel electrodes arranged in a grid-like region compartmentalized by the scanning signal lines and the video signal lines, (D) counter electrodes so arranged that the pixel electrodes and the counter electrodes face each other across a liquid crystal layer, the active matrix liquid crystal display device in which each of the frames is sequentially displayed by (I) driving the counter electrodes, (II) generating image data which corresponds to one of the frames, based on input data, and (III) outputting the image data to a driving circuit, the method including the steps of:

driving the counter electrodes at a frequency higher than a frequency within an audible frequency band for human being;

dividing one frame period, in which the one of the frames is displayed, into (i) a drive period in which the counter electrodes are driven and (ii) a drive suspension period in which the counter electrodes are not driven;

outputting, during the drive period, the image data to the driving circuit at a same frequency as a frequency for driving the counter electrodes; and stopping outputting of the image data to the driving circuit during the drive suspension period.

In the foregoing method, the counter electrode is driven by the frequency higher than the frequency within the audible frequency band for human being. Therefore, vibration-caused noise which is produced while the counter electrode is being driven is not sensed by a user. Further, each of frame periods has the drive period and the drive suspension period. Therefore, even though an amount of power consumption increases accompanied by setting the frequency for driving the counter electrode at a higher frequency, the power is barely consumed during the drive suspension period. This restrains the increase in the amount of power consumed in each of the frame periods. Thus, with the foregoing driving method, it is possible to prevent the noise without increasing the amount of power consumed for driving the liquid crystal display device.

Further, in order to achieve the foregoing object, in a driving device for driving a display section having (A) scanning signal lines, (B) video signal lines, (C) pixel electrodes arranged in a grid-like region compartmentalized by the scanning signal lines and the video signal lines, and (D) counter electrodes so arranged that the pixel electrodes and the counter electrodes face each other across a liquid crystal layer, so that the driving device causes the display section to sequentially display frames of image, a driving voltage whose frequency is higher than an audible frequency band for human being is outputted to the pixel electrodes and the counter electrodes during a part of one period for displaying one frame of image; and the driving voltage is not supplied to the pixel electrodes and the counter electrodes, during a remaining part period for displaying the one frame of image.

Further, a liquid crystal display device of the present invention includes the foregoing driving device and the display section.

In the foregoing configuration, the pixel electrode and the counter electrode are driven by the frequency higher than the frequency within the audible frequency band for human being. Therefore, vibration-caused noise which is produced while the pixel electrode and the counter electrode are being driven is not sensed by a user. Further, each of the frame periods has a period in which the driving voltage is stopped being outputted to the pixel electrode and the counter electrode. Therefore, power consumption is reduced during this period. This restrains the increase in the amount of power consumed in each of the frame periods.

Further, in order to achieve the foregoing object, in an active matrix liquid crystal display device of the present invention including (I) a displaying section having (A) scanning signal lines, (B) video signal lines, (C) pixel electrodes arranged in a grid-like region compartmentalized by the scanning signal lines and the video signal lines, (D) counter electrodes so arranged that the pixel electrodes and the counter electrodes face each other across a liquid crystal layer, (II) a driving circuit for controlling displaying of an image on the display section; and (III) a display control section for generating driving signals for use in controlling the driving circuit based on input signals inputted to the display control section, the display control section includes:

a memory section for storing therein image data to be displayed on the displaying section, the image data represented by a signal of the input signals; and a memory section control device for controlling timing of outputting the image data from the memory section to the driving circuit in accordance with a frequency for driving the counter electrode.

Further, in order to achieve the foregoing object, A display control device for generating a drive signal for use in driving a driving circuit based on input signals, so that the driving circuit controls displaying of an image on a displaying section having (A) scanning signal lines, (B) video signal lines, (C) pixel electrodes arranged in a grid-like region compartmentalized by the scanning signal lines and the video signal lines, (D) counter electrodes so arranged that the pixel electrodes and the counter electrodes face each other across a liquid crystal layer, the display control device including:

a memory section for storing therein image data to be displayed on the displaying section, the image data represented by a signal of the input signals;

a memory section control device for controlling timing of outputting the image data from the memory section to the driving circuit in accordance with a frequency for driving the counter electrode.

In the foregoing configuration, there is provided the memory section for temporarily storing therein the image data to be displayed on the display section. Therefore, based on the input signals inputted to the display control section (i.e. display control device), the memory control device can cause the image data to be outputted to the driving circuit at the cycle corresponding to the frequency for driving the counter electrode. Accordingly, it is possible to output the image data at a desirable frequency and at a desirable timing, even though the frequency and timing on inputting the input signals are different from those on outputting the image data to the driving circuit.

Thus, it is possible to output the image data to the driving circuit during the drive period, also in a case where each of the frame periods has the drive period in which the counter electrode is driven and the drive suspension period in which the counter electrode is not driven. Further, also in a case where, for example, the counter electrode is driven by the frequency higher than the frequency within the audible frequency band for human being, it is possible to output the image data whose frequency is the same as the frequency for driving the counter electrode. Thus, the foregoing driving method is adopted for driving the liquid crystal display device of the present invention.

Additional objects, features, and strengths of the present invention will be made clear by the description below. Further, the advantages of the present invention will be evident from the following explanation in reference to the drawings.

DESCRIPTION OF THE EMBODIMENTS

Embodiment 1

Figure 1:
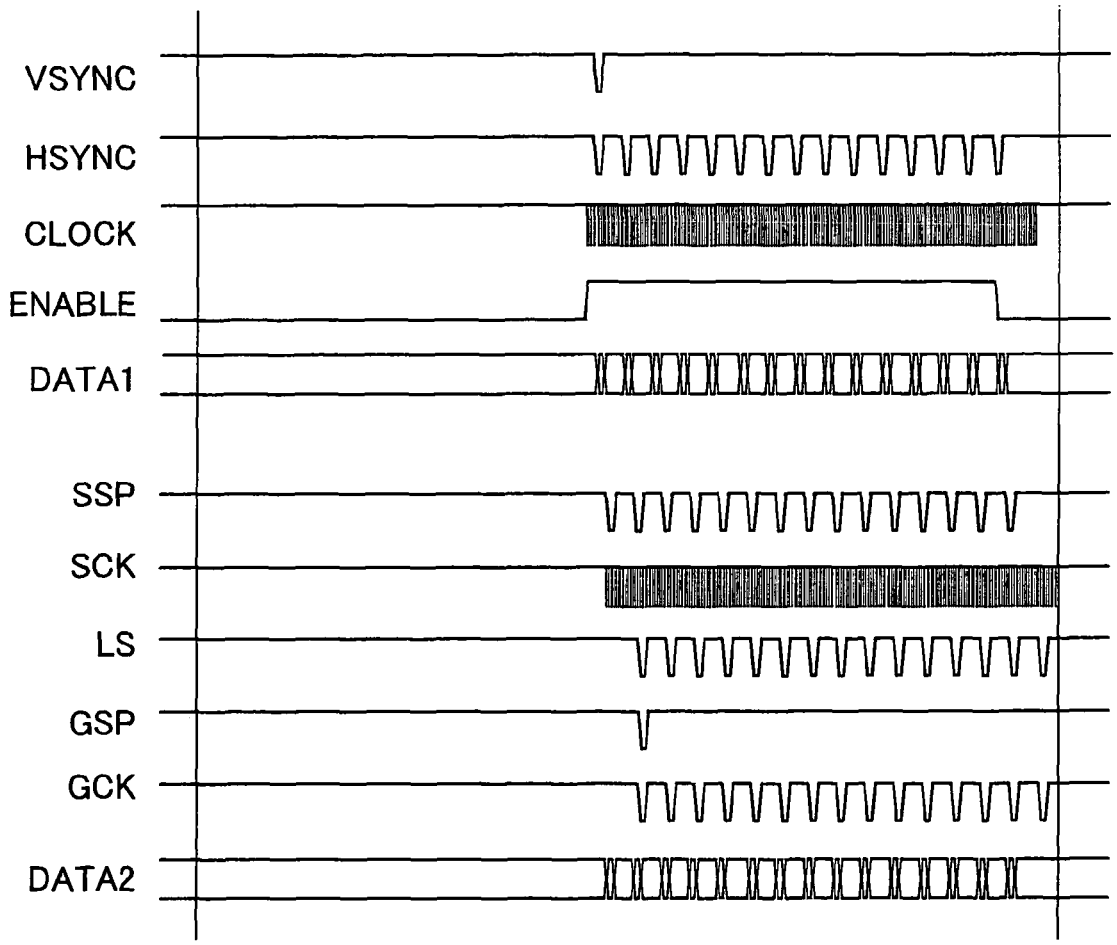
FIG. 1 is a waveform chart showing a timing of driving a liquid crystal display device of an embodiment in accordance with the present invention.
Figure 2:
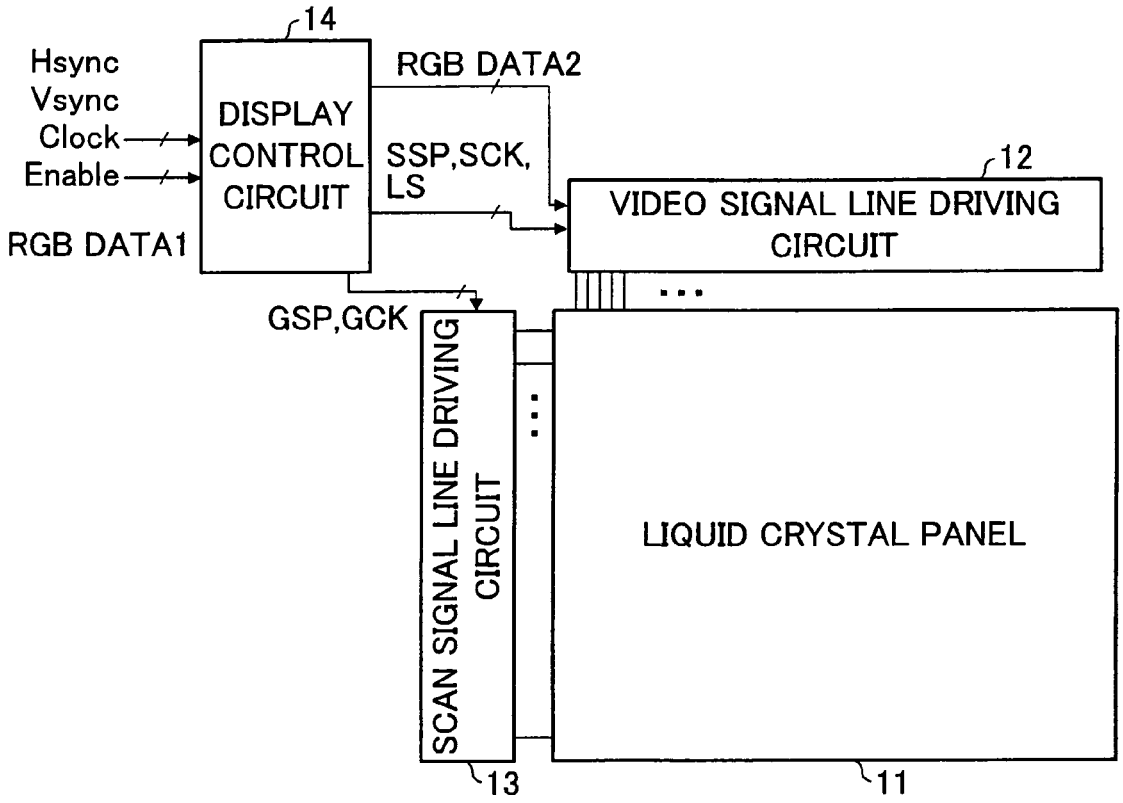
FIG. 2 is a block diagram showing the liquid crystal display device of the embodiment.
Figure 3:
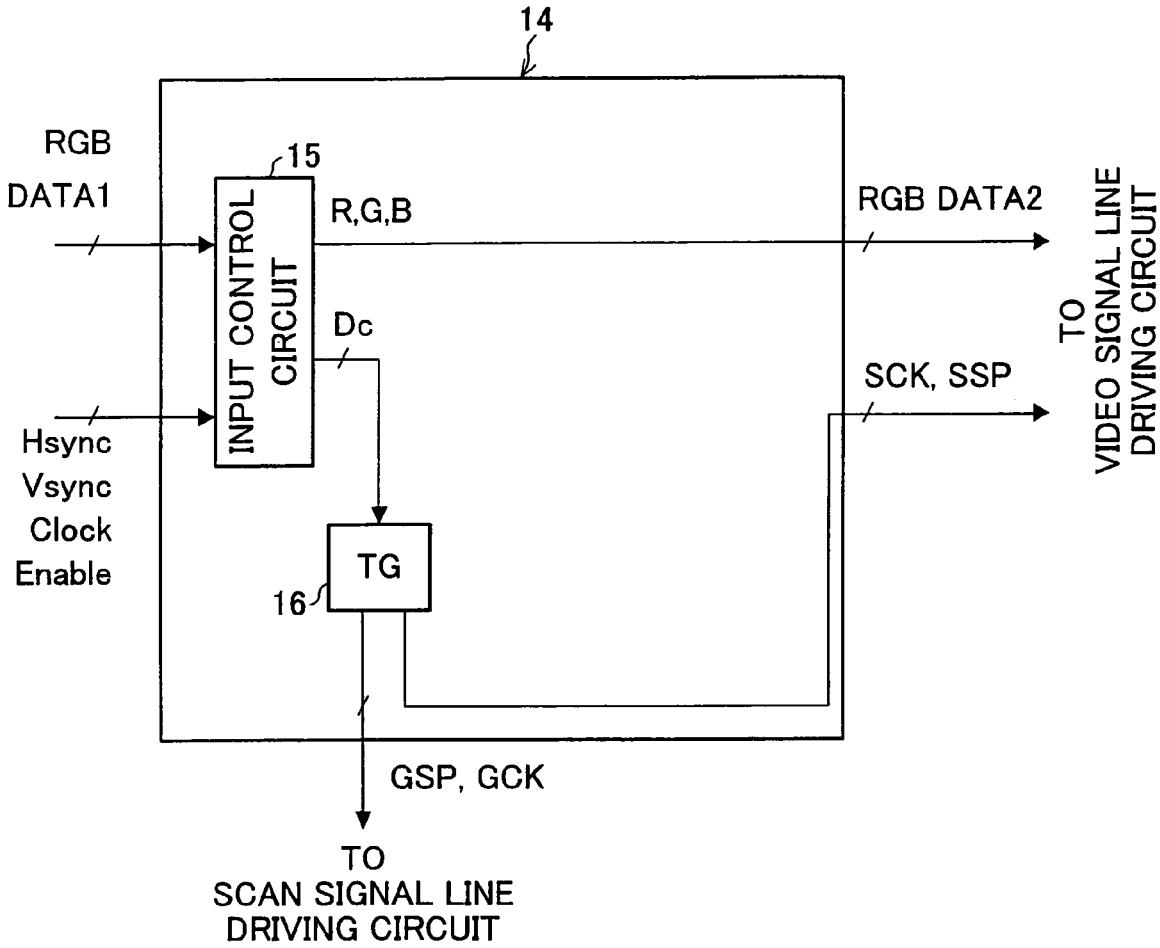
FIG. 3 is a block diagram of a display control circuit provided in the liquid crystal display device of the embodiment.

The following describes an embodiment of the present invention with reference to FIG. 1 through FIG. 5. FIG. 2 is a block diagram showing a configuration of a liquid crystal display device (Hereinafter referred to as LCD device) in accordance with the present invention, and FIG. 3 is a block diagram showing a configuration of a display control circuit provided in the LCD device.

As shown in FIG. 2, the LCD device includes (i) a liquid crystal panel (displaying section; Hereinafter referred to as LC panel) 11 having liquid crystal cells arranged in a matrix manner by being compartmentalized with scan signal lines and video signal lines, (ii) a video signal line driving circuit (driving circuit) 12 for impressing a video signal (image data) to the liquid crystal cells via the video signal lines, (iii) a scan signal line driving circuit 13 for scanning the scan signal lines by successively selecting scan signal lines, and for controlling an ON/OFF of a switching element provided in each of the liquid crystal cells, (iv) a display control circuit (display control section, display control device) 14 for driving the respective video signal line driving circuit 12 and the scan signal line driving circuit 13, based on a signal being inputted from outside, and (v) a counter electrode driving circuit (not shown). The video signal line driving circuit 12, the scan signal line driving circuit 13, the display control circuit 14, and the counter electrode (not shown) constitute a driving device for driving the LC panel 11 thereby causing the LC panel 11 to successively display each frame.

Here, in the LC panel 11, liquid crystal (liquid crystal layer) is interposed between a pair of transparent substrates such as glass substrates facing each other. One of the paired glass substrates is provided with the scan signal lines and the video signal lines. Around each intersecting point of these lines, a switching element such as a TFT and a pixel electrode are provided. Further, another one of the paired glass substrates is provided with the counter electrodes. In a case where the LCD device performs a color-display, color filters for R (red), G (green), and B (blue) are provided corresponding to each of the pixel electrodes.

Further, as shown in FIG. 3, in order to, for example, generate driving signals for driving the pixel electrodes, the display control circuit 14 includes an input control circuit 15 and a TG (timing generator) 16.

The input control circuit 15 controls sending of a signal inputted to the display control circuit 14 to the TG 16 or to the video signal line driving circuit 12. Input signals are inputted to the input control circuit 15. The input signals are (i) a vertical sync signal Vsync (Hereinafter referred to as Vsync), a horizontal sync signal Hsync (Hereinafter referred to as Hsync), a clock signal Clock (Hereinafter referred to as Clock), a write-in permission signal Enable (Hereinafter referred to as Enable), and an RGB data signal DATA1 (input data; hereinafter referred to as DATA1). Among these input signals, the input control circuit 15 outputs the DATA1 as a data signal DATA2 (image data; hereinafter referred to as DATA2) to the video signal line driving circuit 12. Further, to the TG 16, the input control circuit 15 outputs a signal group Dc including the Hsync, Vsync, Clock, and the Enable.

Figure 4:
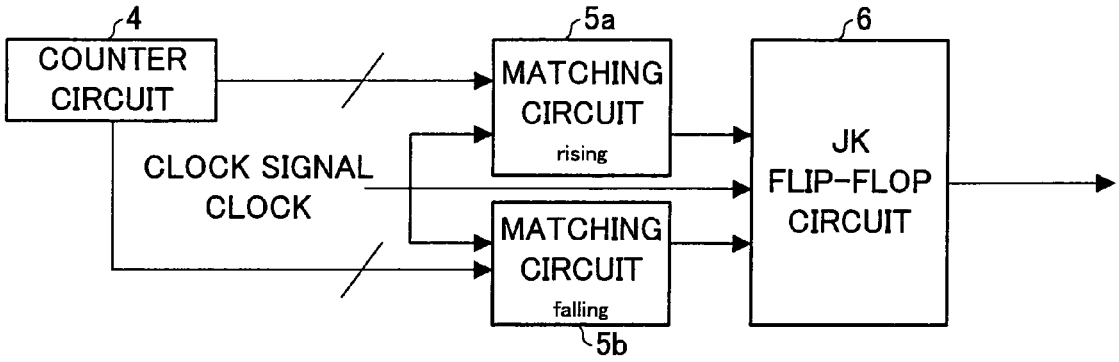
FIG. 4 is a block diagram showing a configuration of a timing generator provided in the display control circuit.

The TG 16 generates the driving signal to be inputted to the video signal line driving circuit 12 and the scan signal line driving circuit 13. As shown in FIG. 4, the TG 16 includes, a counter circuit 4 for counting the Clock inputted to the TG 16, matching circuits 5*a* and 5*b* for determining rising and falling timings of the driving signal generated in the TG 16, and a JK flip-flop circuit 6 for outputting the driving signal as a waveform based on the rising and falling determined in the matching circuits 5*a* and 5*b*. Note that FIG. 4 shows two matching circuits 5*a* and 5*b*, however since the rising and falling timings of the driving signal are determined with respect to each of the driving signals being generated, the number of the matching circuits provided is the double of a number of driving signal generated.

With this configuration, the TG 16 generates, based on the signal group Dc being inputted, a source start signal SSP (Hereinafter referred to as SSP), a source clock signal SCK (Hereinafter referred to as SCK), a latch signal LS (Hereinafter referred to as LS), a gate start signal GSP (Hereinafter referred to as GSP), and a gate clock signal GCK (Herein after referred to as GCK). The SSP, the SCK, and the LS are outputted to the video signal line driving circuit 12, and the GSP and the GCK are outputted to the scan signal line driving circuit 13.

On the contrary, the DATA1 represented by the input signals is outputted as the DATA2, from the input control circuit 15 to the video signal line driving circuit 12. It should be noted that the DATA2, SSP, SCK, LS, GSP, and the GCK are respectively driving signals for driving the LC panel 11.

Next described is a driving method for driving the LCD device having the foregoing configuration. In general, in the LCD device having the foregoing configuration, the video signal is written in each of the liquid crystal cells by carrying out an alternate current driving. For example, in a case where a line-inversion method is adopted for carrying out the alternate driving, polarity of the video signal supplied to the pixel electrodes is inverted every scanning period, on a line-by-line basis for the respective scan signal lines. In the alternate current driving of the LCD device, an effective value of the voltage impressed to the liquid crystal is determined based on a difference between a voltage impressed to the pixel electrodes and a voltage Vcom impressed to the counter electrodes. Accordingly, in the case of driving the LCD device by adopting the line-inversion method, the voltage Vcom is impressed to the counter electrode such that an effect value of the voltage impressed to the liquid crystal is not changed even if the polarity of the voltage impressed to each of the pixel electrodes is inverted. This requires that the polarity of the voltage Vcom impressed to the counter electrodes be inverted in accordance with the inversion of the polarity of the voltage (polarity of the video signal) impressed to the pixel electrodes.

By inverting the polarity of the voltage Vcom impressed to the counter electrodes while the LCD device is being driven, the glass substrate having the counter electrodes vibrates because of the voltage impressed to the counter electrodes. If a frequency of this vibration of the glass substrate is within an audible frequency band for human being, the vibration is recognized as an annoying sound (noise) by a user, while the LCD device is being driven.

In order to prevent the LCD device from producing the noise while the LCD device is being driven, in the present embodiment, a driving frequency of the voltage impressed to the counter electrodes is set at a frequency higher than the audible frequency band for human being (i.e. at 20 kHz or higher). Generally, in the case of driving the LCD device by adopting the line-inversion method, the polarity of the voltage Vcom impressed to the counter electrode is inverted every 1 horizontal (1H) period. Further, the frequency is indicated in a reciprocal of a cycle. As such, the driving frequency f (Hz) for the counter electrode is indicated in a following formula:

$$f(\text{Hz})=1/(2H\ \text{period})$$

(where 2H period is the double of 1H period). Accordingly, in the present embodiment, in order to set the driving frequency f at 20 kHz (20,000 Hz) or higher, the following formula derives from foregoing formula:

$$f(\text{Hz})=20{,}000\geqq 1/(2H\ \text{period}).$$

Thus, 1H period is:

$$1H\ \text{period}\leqq 1/40{,}000\ \text{Hz}=25\ \mu\text{s}.$$

In short, in the present embodiment, the driving frequency f for the counter electrode is set at 20 kHz or higher by setting 1H period at 25 μs or less.

As described, in the present embodiment, the driving frequency (frequency of the driving voltage) for each of the pixel electrodes and the counter electrodes are set at 20 kHz or higher, by driving the LCD device by a method such as the line-inversion driving method, in which the polarity of the driving voltage to be impressed to the counter electrodes is inverted at an interval of 25 μseconds or less. As such, even if the glass substrate is vibrated, a frequency of the vibration is at 20 kHz or higher, i.e. higher than the audible frequency band for human being. Thus, the vibration is not recognized by the user as the annoying sound (noise).

Incidentally, if the driving frequency for the counter electrode is set at 20 kHz or higher, the LCD device is driven at a higher speed than a typical case. This causes a large increase in power consumption for driving the LCD device. In a meanwhile, for example, in the LC panel 11 which is used in a typical mobile phone or the like and has a resolution of QVGA (240×320 dot), there are 320 scan signal lines. Therefore, if 1H period is 25 μs, the period needed for impressing the voltage to the liquid crystal cells corresponding to 1 frame is:

$$25\ \mu\text{s}\times 320\ \text{lines}=8\ \text{ms}.$$

In a general LCD device, a period needed for displaying one frame, i.e. 1 Vertical period (1 frame period; hereinafter referred to as 1V period) is 1/60 s (about 16.7 ms). Accordingly, if the driving frequency for the counter electrodes is set at 20 kHz or higher, it is possible to impress the voltage to the liquid crystal cells corresponding to the 1 frame, in about 8 ms, i.e. a half of 1V period (about 16.7 ms).

For this reason, in the present embodiment, after the video signal for one frame is written in, there is provided a period in which no video signal is written in. More specifically, the counter electrode and the pixel electrode are driven for about a half of the 1V period, so that the video signal is written into the liquid crystal cells, and the counter electrode and the pixel electrodes are not driven for the rest of the 1V period so that power consumption is saved. This allows the LCD device to be driven with power consumption similar to that in a case where the driving frequency for the counter electrodes is not set at the higher frequency. Thus, it is possible to prevent the increases in the power consumption caused by the increase of the driving frequency for the counter electrodes or the pixel electrodes.

While the LCD device is performing displaying, the voltage is impressed to the liquid crystal in the liquid crystal cells between the pixel electrode and the counter electrode. Therefore, as to impressing the voltage to the liquid crystal, it is necessary to drive the pixel electrodes and the counter electrodes at same timing. Accordingly, as described, in order to drive the LCD device in which each of frame periods have (i) a period in which the video signal is written in by driving the counter electrodes (Hereinafter referred to as drive period) and (ii) a period in which the counter electrode is not driven and the video signal is not written in (Hereinafter referred to as drive suspension period), it is necessary to synchronize a timing of writing in the video signal to the liquid crystal cells with a timing of driving the counter electrodes. In other words, as to writing the DATA2 into the respective liquid crystal cells, it is necessary that the polarity of the DATA2 be inverted every 1H period determined based on the driving frequency f for the counter electrodes.

In the present embodiment, as to writing the video signal into the respective liquid crystal cells, the frequency of the data signal DATA2 is set at a high frequency in accordance with the driving frequency f for the counter electrode being set at a high frequency, so that the timing of writing in the DATA2 is synchronized with the timing of driving the counter electrodes. The following describes the timing of writing in the video signal, with reference to FIG. 1. FIG. 1 is a waveform chart of a driving waveform, and is showing a timing in 1V period for driving a liquid crystal display device of the present embodiment.

Firstly, as to displaying an image on the LCD device having the foregoing configuration, input signals (i.e. the Hsync, Vsync, Clock, Enable, and the DATA1) are inputted to the display control circuit 14 shown in FIG. 3. Each of the foregoing input signals is inputted to the input control circuit 15 in the display control circuit 14, at a timing shown in FIG. 1.

As described, in the present embodiment, 1H period is so determined that the driving frequency f for the counter electrodes is set at a desirable frequency. Accordingly, the Hsync and the DATA1 inputted to the display control circuit 14 respectively have waveforms synchronized with 1H period determined based on the driving frequency f. Further, the Vsync inputted to the display control circuit 14 has a waveform synchronized with a frame frequency. In short, in the present embodiment, the frequencies of the respective input signals are set at a high frequency without changing the frame frequency, in order to correspond with the driving frequency f being set at the high frequency.

Among the input signals inputted to the input control circuit 15 of the display control circuit 14, the Hsync, the Vsync, the Clock, and the Enable are sent to the TG 16. Based on these signals, the TG 16 generates the SSP, SCK, LS, GSP, and GCK.

More specifically, a falling of the Vsync is detected by using the counter circuit 4. Next, the counter circuit 4 shown in FIG. 4 starts counting the Clock inputted to the input control circuit 15. By resetting the counter circuit 4 at the rising of the Hsync, the counter circuit 4 causes the matching circuits 5*a* and 5*b* to determine the timing of rising and falling of the respective driving signals, i.e. the SSP, SCK, LS, GSP, and the GCK. More specifically, based on a count value or the like obtained by the counter circuit 4, the matching circuit 5*a* outputs pulses at the respective rising timings of the SSP, SCK, LS, GSP, and the GCK. In the meanwhile, based on the count value or the like obtained by the counter circuit 4, the matching circuit 5*b* outputs pulses at the respective falling timings of the SSP, SCK, LS, GSP, and the GCK. Based on the timing determined here (output timings of the pulses from the matching circuits 5*a* and 5*b*), the JK flip-flop circuit 6 generates waveforms of the SSP, SCK, LS, GSP, and the GCK (See FIG. 1).

As described, in the present embodiment, the respective driving signals are generated based on the Clock and the Hsync respectively being inputted. Therefore, these driving signals are generated in a cycle synchronized with the Hsync. As mentioned before, the Hsync is set at a high frequency in accordance with the driving frequency for the counter electrodes. As such, the respective driving signals generated by the TG 16 are also set at the high frequency.

The SSP, SCK, and the LS thus generated in the TG 16 are outputted to the video signal line driving circuit 12, and the GSP and the GCK thus generated in the TG 16 are outputted to the scan signal line driving circuit 13.

On the other hand, among the input signals inputted to the input control circuit 15 of the display control circuit 14, the DATA1 is outputted as the DATA2 from the input control circuit 15 to the video signal line driving circuit 12 (FIG. 2). The input control circuit 15 detects the falling of the Vsync. Then, the input control circuit 15 counts the supplied Clock, and the counting is reset at the falling of the Hsync. This determines timing of outputting the DATA1, i.e. timing of rising and falling of the DATA2, and the DATA 2 is outputted from the input control circuit 15 to the video signal line control circuit 12 (FIG. 1).

As described, when the respective driving signals are outputted to the video signal line driving circuit 12 and to the scan signal line driving circuit 13, the SSP inputted from the display control circuit 14 causes the video signal line driving circuit 12 to start sampling the DATA2, in accordance with the SCK (See FIG. 1). When the video signal line driving circuit 12 samples the DATA2 corresponding with 1H period, a liquid crystal driving voltage corresponding with the sampled DATA2 is outputted to the video signal line of the LC panel 11, by inputting the LS.

On the other hand, as shown in FIG. 1, the GSP is outputted once every 1V period from the display control circuit 14 to the scan signal line driving circuit 13. The GCK is outputted once every 1H period from the display control circuit 14 to the scan signal line driving circuit 13.

When the scan signal line driving circuit 13 receives the GSP and the GCK, the voltage for switching on the TFT is outputted to a first scan signal line. This switches on the TFT on the first scan signal line, and a voltage of the DATA2 transmitted via the video signal line is charged in the liquid crystal cells. Then, through a similar operation, the voltage for switching on the TFTs on a second scan signal line is outputted to the second scan signal line. When the TFTs on the second scan signal line are switched on, the TFTs on the first scan signal line are switched off and retain the voltage charged to the liquid crystal cells.

As described, the scan signal line driving circuit 13 is synchronized with the timing signal such as the gate start signal GSP and the gate clock signal GCK from the display control section 14, and successively selects and scans the scan signal lines, thereby controlling the ON/OFF of the TFTs. Through the operation, the voltage is charged and retained in the TFTs on the all of the scan signal lines intersecting one of the video signal lines, thus completing the writing-in of the DATA 2 corresponding to one frame. As a result, the LC panel 11 displays an image.

As described, for example, in a case where the LC panel 11 has the resolution of QVGA (240×320 dot), and 1H period is 25 μs, it only takes 8 ms to write in the DATA 2 corresponding to one frame. In a typical LCD device, 1V period is about 16.7 ms. Accordingly, in the present embodiment, after the DATA2 is written in, the writing in of the DATA2 and the driving of the counter electrodes are suspended until a start of a next 1V period, i.e. until the outputting of the DATA2 to the next video signal line is resumed (See FIG. 1). Then, the outputting of the DATA2 to the video signal line driving circuit 12 is resumed, at the timing of detecting the Vsync.

That is to say that, in the present embodiment, the video signal line driving circuit 12 and the counter electrode driving circuit (not shown) output the driving voltage, whose frequency is higher than the audible frequency band for human being, to the pixel electrode and the counter electrode, during a part of one frame period (the drive period (e.g. 8 ms) in one frame period (e.g. 16.7 ms)). On the other hand, the video signal line driving circuit 12 and the counter electrode driving circuit (not shown) stop outputting the driving voltage to the pixel electrode and the counter electrode, during a remaining part of one frame period (e.g. during the drive suspension period (e.g. 8.7 ms)).

In the present embodiment, the driving frequency for the counter electrodes as well as the frequencies of the Hsync and the DATA1 to be inputted to the display control circuit 14 are set higher than the audible frequency band for human being. This allows the frequency of the vibration, which is caused by the driving of the counter electrodes, to be higher than the audible frequency band for the human being. Thus, the vibration is not recognized as the noise from the LCD device, while the LCD device is being driven.

Further, by setting the Hsync and the DATA1 at the high frequency, it takes less time to impress the DATA2 to the liquid crystal cells (i.e. less driving period). It is not necessary to drive the counter electrode during the part of 1V period, in which the data signal is not impressed (during the drive suspension period in which the pixel electrodes are not driven), provided that the driving of the counter electrode is synchronized with the timing of impressing the DATA2. This prevents the increase in an amount of power needed in driving the pixel electrodes and the counter electrodes.

Note that the present embodiment deals with a case where the driving frequency f for the counter electrodes is 20 kHz, but it is possible to make 1H period even shorter by setting the driving frequency f higher than 20 kHz. However, it is necessary that capacity of members such as an amplifier in the LCD device be improved, in order to sufficiently charge the liquid crystal in the liquid crystal cells. Therefore, the driving frequency for the counter electrodes is preferably set so as to enable the liquid crystal cells to be sufficiently charged using the members provided in the LCD device.

Figure 5:
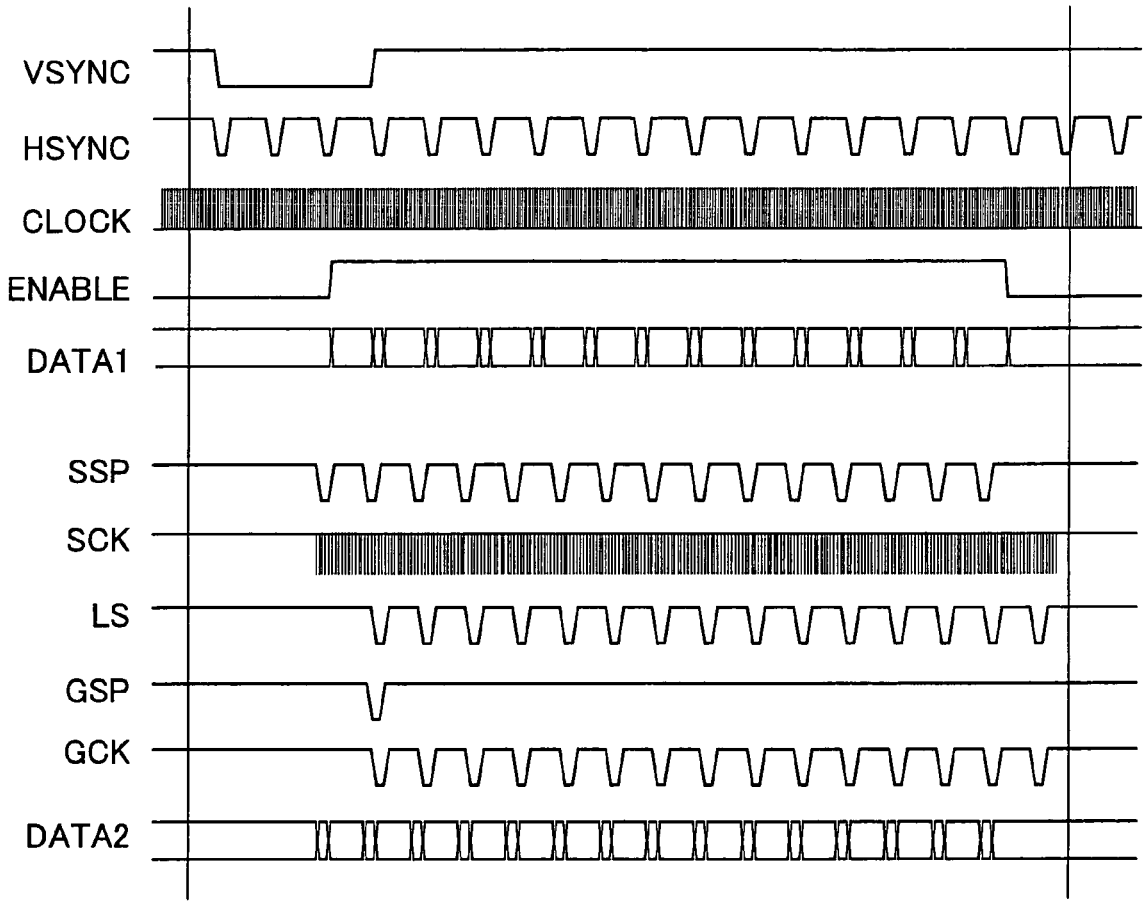
FIG. 5 is a waveform chart showing an exemplary timing of driving a liquid crystal display device in which frame frequency thereof is 60 Hz, and a number of scan signal lines thereof is 666 or more.

Further, the driving frequency for the counter electrodes is generally dependent on the resolution of the LCD device and the frame frequency as to driving the LCD device, i.e. a period for scanning all of the scan signal lines intersecting one of the video signal lines. Accordingly, as shown in FIG. 5, in a case where the frame frequency is 60 Hz and a number of the scan signal lines is 666 or more, the driving frequency for the counter electrodes becomes 20 kHz or higher even if an entire 1V period is the drive period. Therefore, in this case in which the number of the scan signal lines is 666 or more, it is not necessary to provide the drive period and the drive suspension period as shown in FIG. 1, in the 1V period.

Embodiment 2

Figure 6:
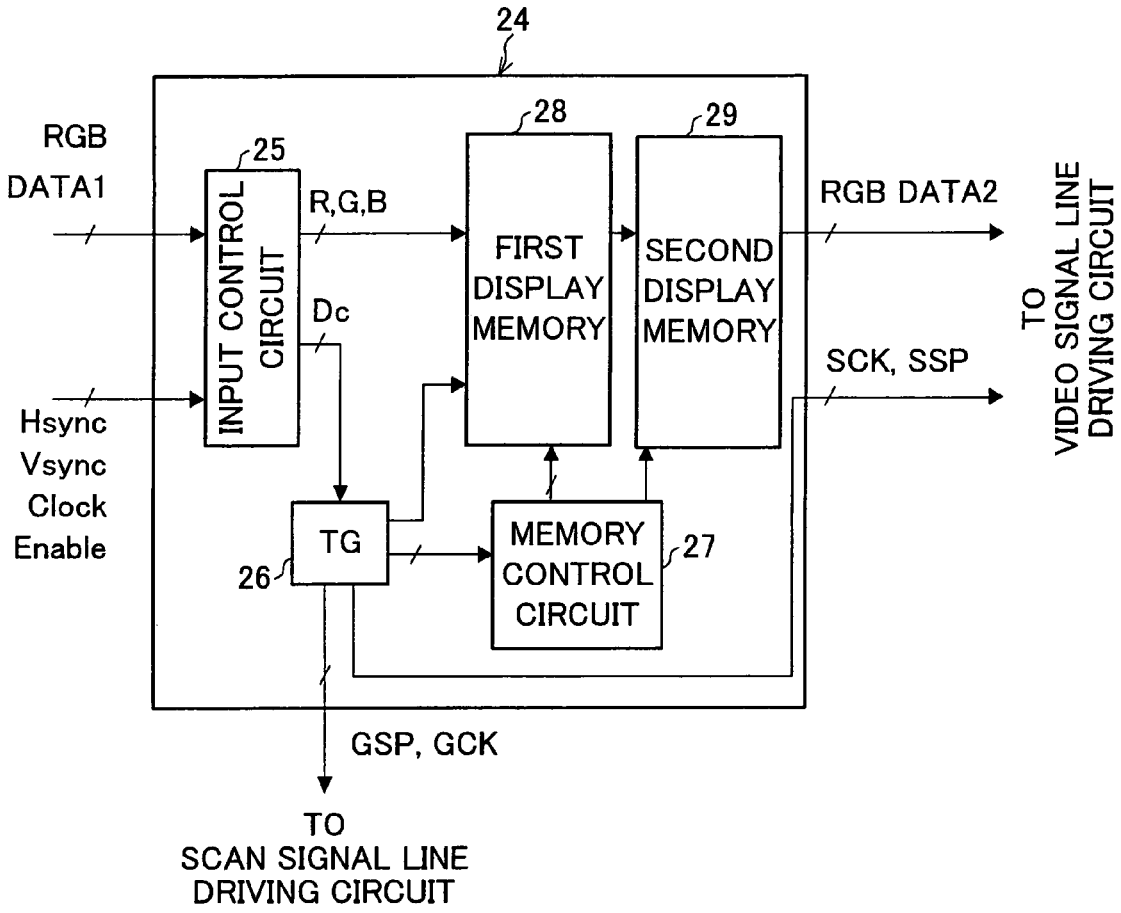
FIG. 6 is a block diagram showing a display control circuit provided in a liquid crystal display device of another embodiment in accordance with the present invention.
Figure 7:
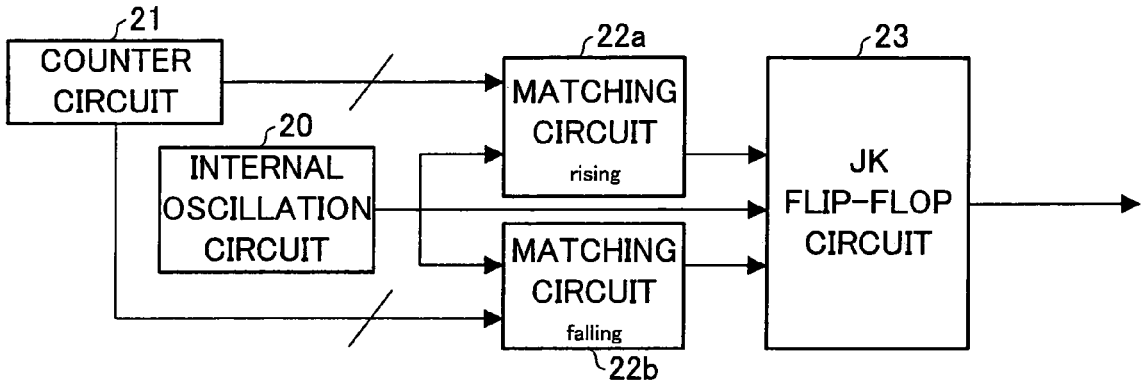
FIG. 7 is a block diagram showing a configuration of a timing generator provided in the display control circuit shown in FIG. 6.
Figure 8:
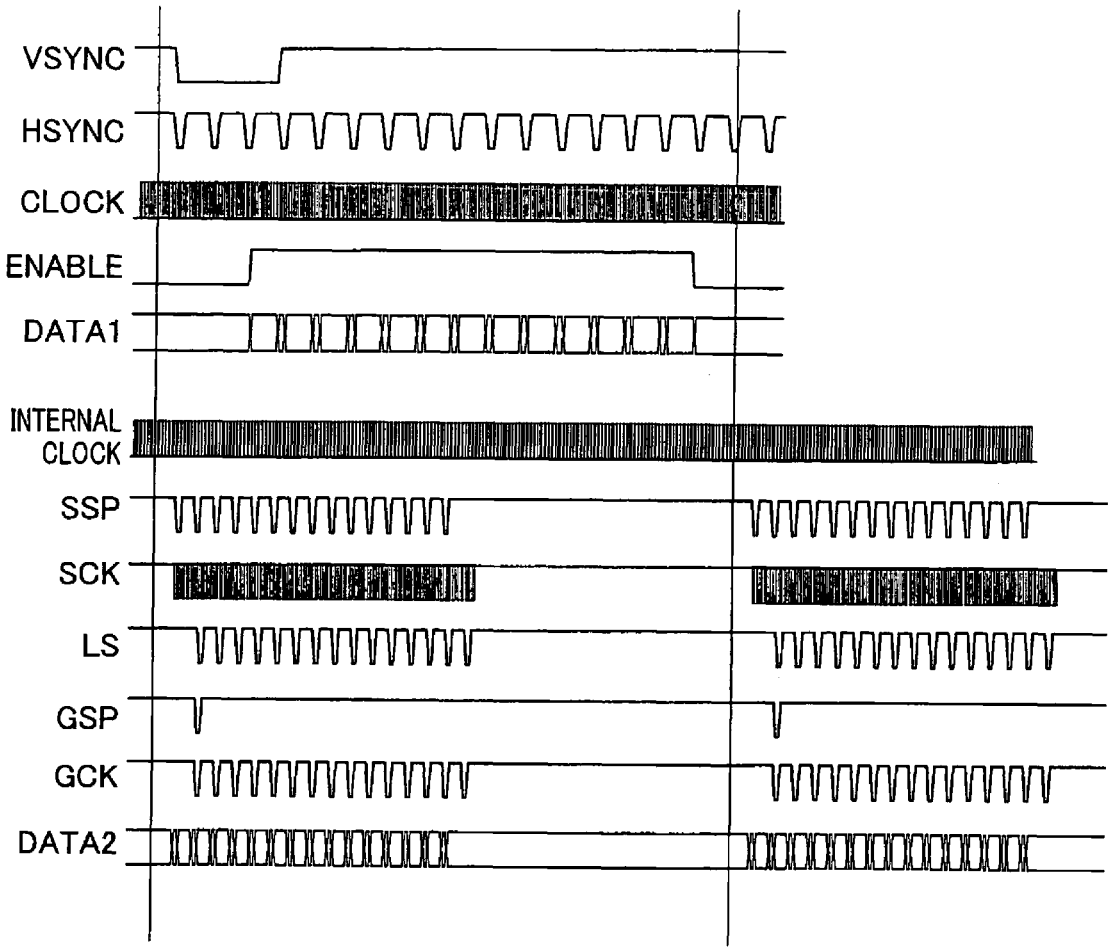
FIG. 8 is a waveform chart showing a timing of driving the liquid crystal display device of said another embodiment in accordance with the present invention.

The following describes another embodiment of the present invention with reference to FIG. 6 to FIG. 8. It should be noted that the same symbols are given to the members that have the same functions as those shown in figures of the foregoing embodiment 1, and the descriptions of those members are omitted here as a matter of convenience.

A liquid crystal display device (Hereinafter referred to as LCD device) of the present embodiment includes a display control circuit 24 shown in FIG. 6, instead of a display control circuit 14 (FIG. 3) provided in an LCD device of the foregoing embodiment 1. FIG. 6 is a block diagram showing a configuration of the display control circuit 24 provided in the LCD device of the present embodiment.

As shown in FIG. 6, in order to, for example, generate driving signals for driving pixel electrodes, the display control circuit 24 includes an input control circuit 25, a TG (timing generator) 26, a memory control circuit 27, a first display memory (memory section; first memory section) 28, and a second display memory (memory section; second memory section) 29.

The input control circuit 25 is for sending a signal inputted into the display control circuit 24 to the TG 26 or the first display memory 28. A horizontal sync signal Hsync (Hereinafter referred to as Hsync), a vertical sync signal Vsync (Hereinafter referred to as Vsync), a clock signal Clock (Hereinafter referred to as Clock), a write-in permission signal Enable (Hereinafter referred to as Enable), and an RGB data signal DATA1 (Hereinafter referred to as DATA1) are respectively inputted as input signals into the input control circuit 25. The input control circuit 25 sends the DATA1 to the first display memory 28, and sends a signal group Dc including the Hsync, Vsync, Clock, and Enable to the TG 26.

The TG 26 generates signals to be inputted to the first display memory 28, a video signal line driving circuit 12, and to a scan signal line driving circuit 13. As shown in FIG. 7, the TG 26 includes (i) an internal oscillation circuit 0.20 for generating an internal clock signal which is the clock signal whose frequency is made higher in accordance with driving frequency of counter electrodes, (ii) a counter circuit 21 for counting the internal clock signal, (iii) matching circuits 22*a* and 22*b* for determining timing of rising and falling of the driving signals generated in the TG 26, and (iv) a JK flip-flop circuits 23 for outputting the driving signals as waveforms, in accordance with the rising and falling detected by the matching circuit 22*a* and 22*b*. Note that FIG. 7 shows two matching circuits 22*a* and 22*b*, however since the rising and falling timings of the driving signals are determined with respect to each of the driving signals being generated, the number of the matching circuits provided is the double of a number of driving signals generated.

With this configuration, the TG 26 generates, based on the signal group Dc being inputted, a source start signal SSP (Hereinafter referred to as SSP), a source clock signal SCK (Hereinafter referred to as SCK), a latch signal LS (Hereinafter referred to as LS), a gate start signal GSP (Hereinafter referred to as GSP), and a gate clock signal GCK (Herein after referred to as GCK). Then, the TG 26 outputs (i) the generated driving signals therein to the memory control circuit 27, (ii) the SSP, SCK, and the LS to the video signal line driving circuit 12, and (iii) the GSP and the GCK to the scan signal line driving circuit 13.

It should be noted that the DATA1 inputted to the TG 26 from the input control circuit 25 is sent to the memory control circuit 27 via the TG 26. Further, the TG 26 outputs the Clock to the first display memory 28, while the Enable is set high. This causes the DATA1 to be stored in the first display memory 28, in sync with the inputted DATA1.

The memory control circuit 27 controls (i) storing of the DATA1 in the first and second display memories 28 and 29, and/or (ii) reading out of the DATA1 and a data signal DATA2 (Hereinafter referred to as DATA2) from the first and second display memories 28 and 29.

The first display memory 28 which is a RAM or the like stores the DATA1 sent from the input control circuit 25, and outputs the DATA1 to the second display memory 29. Further, the second display memory 29 which is also the RAM or the like stores the DATA1 from the first display memory 28, and reads out the stored DATA1 at a predetermined timing, then outputs the DATA1 as the DATA2 to the video signal line driving circuit 12.

Similarly to the foregoing embodiment 1, in the LCD device having the display control circuit 24 having the above-described configuration, a driving period and a drive suspension period are provided and a video signal is written in at a timing shown in FIG. 8. FIG. 8 is a waveform chart of a driving waveform in the LCD device of the present invention, and indicates timing of driving.

Input signals (i.e. the Hsync, Vsync, Clock, Enable, and DATA1) are inputted into the input control circuit 25 of the display control circuit 24 shown in FIG. 6. Unlike the foregoing embodiment 1, frequencies of these input signals are not set at a high frequency. More specifically, in order to prevent a noise from being produced from the LCD device, the frequencies of the input signals in the present embodiment are not set high accordingly to timing of counter electrode driving frequency whose frequency is set high. Accordingly, in the present embodiment, the input signals, for indicating a timing of writing data signal DATA2 (Hereinafter referred to as DATA2) into each of liquid crystal cells, respectively have frequencies that are different from those of signals described in the foregoing embodiment 1. That is to say that, in the present embodiment, (i) the DATA1 and the Hsync to be inputted to the display control circuit 24 respectively have the frequencies that are different from those of the SSP, LS, and the GCK, (ii) the Vsync and the Enable respectively have the frequencies that are different from those of the GSP, and (iii) the Clock has the frequency that is different from that of the SCK.

Therefore, in the present embodiment, driving signals (i.e. the SSP, SCK, LS, GSP, GCK and the DATA2) are generated with the respective frequencies being set high in accordance with the counter electrode driving frequency, so as to allow the DATA2 to be written into each of the liquid crystal cells.

More specifically, When the Hsync, Vsync, Clock and the Enable are inputted to the TG 26 from the input control circuit 25, the SSP, SCK, LS, GSP, and the GCK are generated in the TG 26 as follows.

That is; the counter circuit 21 shown in FIG. 7 first detects a falling of the Vsync. Then, the counter circuit 21 receives the internal clock signal generated by the internal oscillation circuit 20 provided in the TG 26 shown in FIG. 7, and starts counting the internal clock signal. Here, in order to obtain the drive signals whose frequencies are set high, the internal clock signal has a frequency which is higher than that of the clock signal (Clock in FIG. 1) used in the counter circuit 4 in the foregoing embodiment 1; i.e. the frequency of the internal clock signal is higher than the Clock to be inputted to the display control circuit 24. More specifically, for example, the internal clock signal is so generated that frequency thereof is about twice as high as the frequency of the Clock inputted into the display control circuit 24.

At this point, in order to obtain the drive signals whose frequencies are higher than those of the input signals, the counter circuit 21 resets a counter every time a counter electrode voltage Vcom is inverted. As described in the foregoing embodiment 1, an interval of inverting the counter electrode voltage can be calculated based on the counter electrode driving frequency f of the counter electrodes. In this way, the matching circuits 22*a* and 22*b* can determine the timing of rising and falling of each of the driving signals (i.e. the SSP, SCK, LS, GSP, and GCK). More specifically, based on a count value or the like obtained by the counter circuit 21, the matching circuit 22*a* outputs pulses at the respective rising timings of the SSP, SCK, LS, GSP, and GCK. In the meanwhile, based on the count value obtained by the counter circuit 21, the matching circuit 22*b* outputs pulses at the respective falling timings of the SSP, SCK, LS, GSP, and GCK. Based on the timing determined here (output timings of the pulses from the matching circuits 22*a* and 22*b*), the JK flip-flop circuit 23 generates waveforms of the SSP, SCK, LS, GSP, and GCK.

As described, the driving signals whose respective frequencies are set high as shown in FIG. 8 can be obtained by generating each of the driving signals based on (i) the internal clock signal whose frequency is set high and (ii) the counter electrode driving frequency f for the counter electrode. Unlike the foregoing embodiment 1, in the present embodiment, the frequencies of the Clock and Hsync respectively inputted into the display control circuit 24 are not set high accordingly to the counter electrode driving frequency. Accordingly, even though the counter circuit 21 counts the Clock and resets the counting based on the Hsync, the frequencies of the respective driving signals generated in the TG 26 cannot be set high.

In view of that, as described, the TG 26 of the present embodiment is provided with the internal oscillation circuit 20. In this internal oscillation circuit 20, the internal clock signal whose frequency is set high in accordance with the counter electrode driving frequency is generated. Further, the timing of rising and falling of the respective driving signals is determined based on the timing of inverting the voltage Vcom calculated from the counter electrode driving frequency. Thus, in the TG 26, the respective frequencies of the driving signals are set high when the respective driving signals are generated. These driving signals are outputted during the driving period in which the counter electrodes and the pixel electrodes are driven, and are not outputted during the drive suspension period in which the counter electrodes and the pixel electrodes are not driven. In other words, the TG 26 outputs the driving signals having such waveforms that electric potential fluctuates during the drive period, and that the electric potential is always 0 (zero) during the drive suspension period.

Among the driving signals thus generated, the SSP, SCK, and the LS are outputted to the video signal line driving circuit 12, and the GSP and the GCK are outputted to the scan signal line driving circuit 13.

In the meanwhile, as shown in FIG. 8, among the input signals inputted into the display control circuit 24, the DATA1 is inputted during the drive suspension period as well as the drive period. However, since the drive period and the drive suspension period are provided in each 1V period in the present embodiment, the liquid crystal cells are not charged while the counter electrodes are not driven, even if the DATA2 is sent from the display control circuit 24 to the video signal line driving circuit 12 at the timing of inputting the DATA1 into the display control circuit 24.

For this reason, the inputted DATA1 is sent from the input control circuit 25 to the first display memory 28, and is temporarily stored in the first display memory 28. Then, the memory control circuit 27 causes the first display memory 28 to output the DATA1 at a predetermined timing to the second display memory 29, and causes the second display memory 29 to store the DATA1. Then, from the second display memory 29, the DATA1 is outputted as the DATA2 to the video signal line driving circuit 12, during the next 1V period. In short, in the present embodiment, the DATA2 is outputted during the 1V period (FIG. 8) in succession to the 1V period in which the DATA1 is inputted. Accordingly, there is a time lag of about 1V period between the timing of inputting the DATA1 and the timing of outputting the DATA2.

Here, the predetermined timing of outputting the from the first display memory 28 to the second display memory 29 is not limited, provided that all of the DATA1 corresponding to 1V period (i.e. 1 frame) is stored in the first display memory 28. However, in order to avoid delay in displaying the image on the LC panel 11, the DATA2 is preferably written in as early as possible in the following 1V period. Therefore, it is preferable that the DATA1 be sent from the first display memory 28 to the second display memory 29 within the 1V period in which the DATA1 is inputted.

When the first and the second display memories 28 and 29 complete transmission of the DATA1, the memory control circuit 27 starts counting the internal clock signal generated in the internal oscillation circuit 20 of the TG 26 at a rising timing of the Vsync. Then, every time the counter electrode voltage Vcom is inverted, the memory control circuit 27 resets the counting of the internal clock signal. In this way, the timing of outputting the inputted DATA1, i.e. the timing of the rising and falling of the DATA2 is determined, and the memory control circuit 27 causes the DATA2 to be outputted to the video signal line driving circuit 12 as shown in FIG. 8. In this way, the DATA2 is outputted from the second display memory 29 in accordance with the internal clock signal whose frequency is set high and the counter electrode driving frequency f. That is to say that the DATA 2 is outputted at a cycle corresponding to a frequency of the driving voltage to be impressed to the pixel electrodes and the counter electrodes. Therefore, the frequency of the DATA2 is set high as shown in FIG. 8.

Then, similarly to the foregoing embodiment 1, when the driving signals are outputted from the display control circuit 24 to the video signal line driving circuit 12 and the scan signal line driving circuit 13, the voltage is charged and retained in the liquid crystal cells, so that the image is displayed on the LC panel 11.

As described, in the display control section 24 of the present embodiment, (i) the TG 26 is provided therein with the internal oscillation circuit 20 with which the internal clock signal whose frequency is high is generated, and (ii) the driving signals are generated based on the internal clock signal and the counter electrode driving frequency. With this configuration, even though the frequencies of the input signals are different from the counter electrode driving frequency, it is possible to drive the LCD device by (i) generating the driving signals whose frequencies are synchronized with the counter electrode driving frequency, and (ii) providing the driving period and the drive suspension period in each of the 1V periods. Thus, the noise produced while the LC panel 11 is driven is prevented, by driving the counter electrodes during the driving period of each 1V period, at a frequency higher than an audible frequency band for the human being. Further, since each of the 1V periods is provided with the drive suspension period in which almost no power is consumed, an increase in power consumption caused by driving the LCD device with the high frequency is compensated with the drive suspension period. This prevents an increase in the power consumed in an entire LCD device.

It should be noted that capacities of the first and second display memories 28 and 29 used in the present embodiment may be determined in consideration of a resolution of the LC panel 11, DATA1 to be inputted, and the DATA2 to be outputted. For example, in the present embodiment in which the data signals inputted in the 1V period are temporarily stored in each of the memories, the capacities are not necessarily larger than an amount of data corresponding to the image displayed within the 1V period. Less capacities of the memories realize a smaller LCD device, thereby further reducing costs.

Embodiment 3

Figure 9:
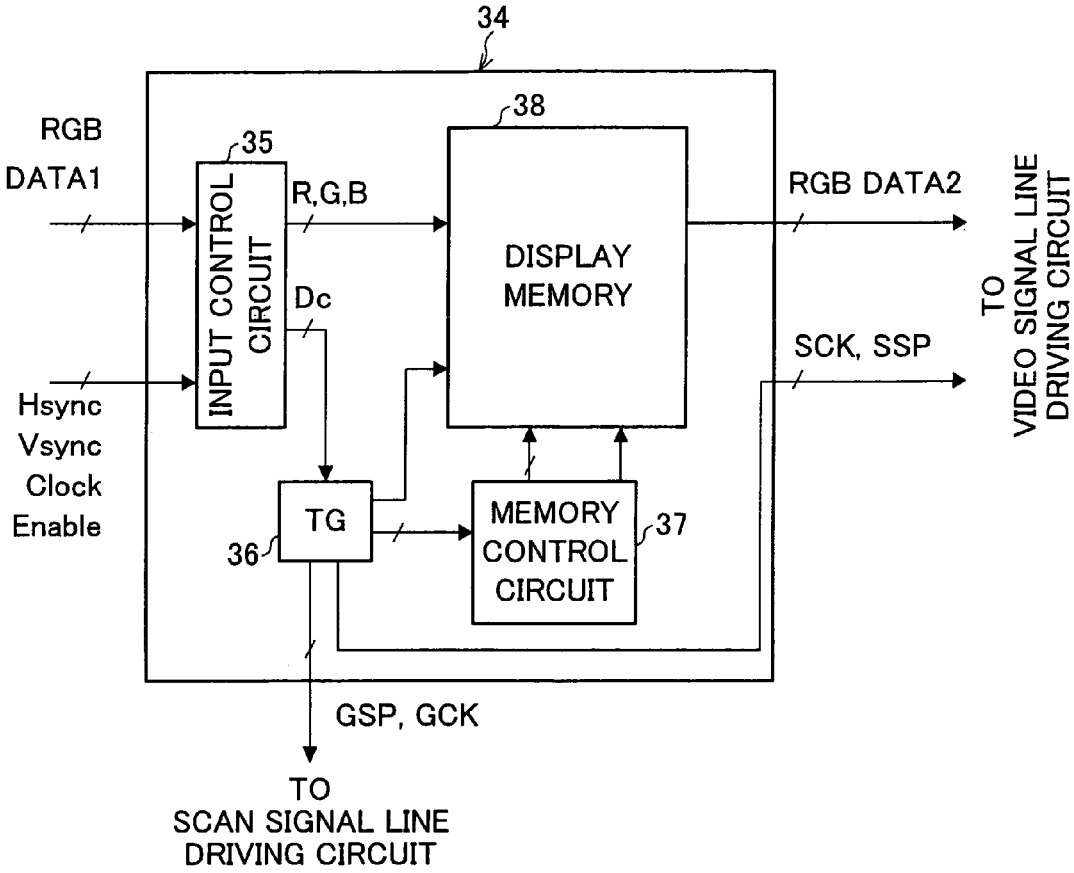
FIG. 9 is a block diagram showing a display control circuit provided in a liquid crystal display device of yet another embodiment in accordance with the present embodiment.
Figure 10:
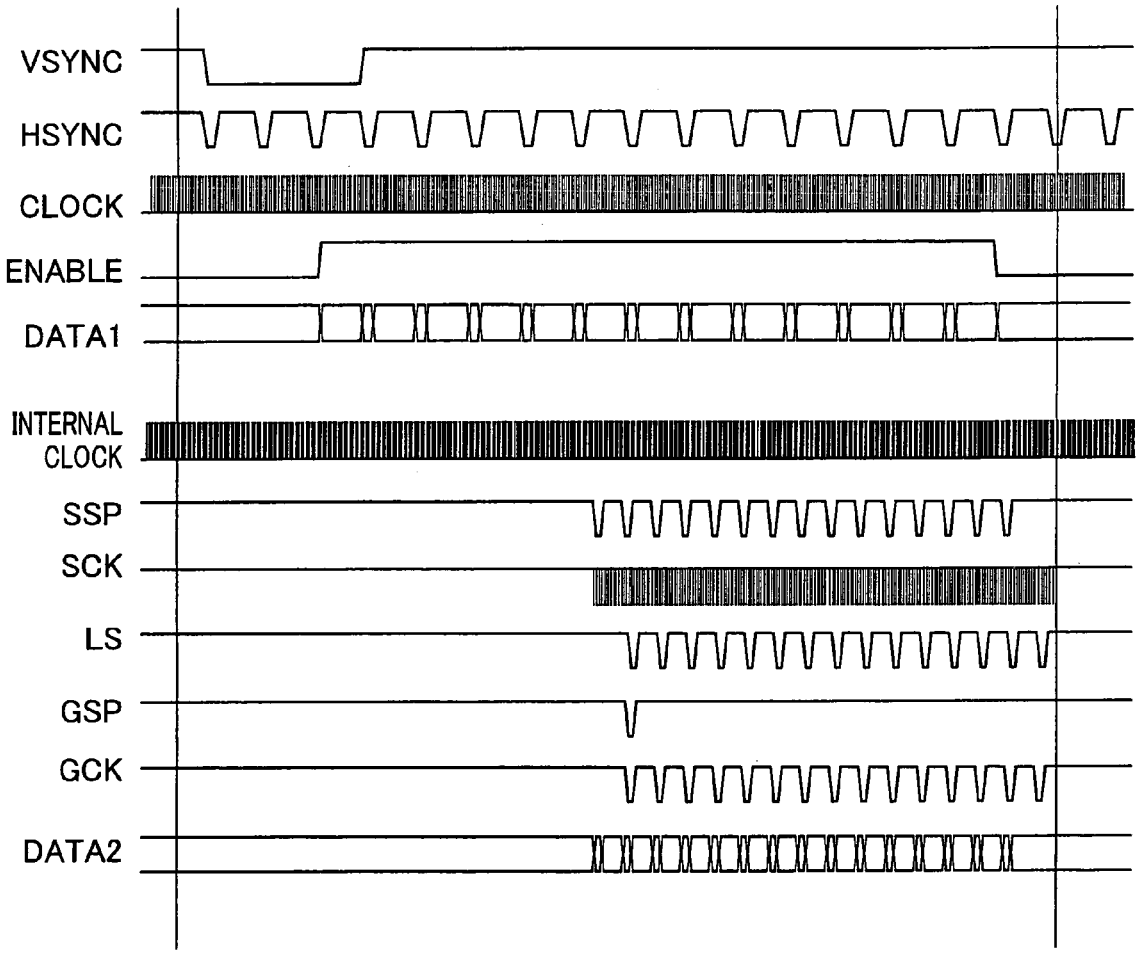
FIG. 10 is a waveform chart showing a timing of driving the liquid crystal display device of said yet another embodiment in accordance with the present invention.
Figure 11:
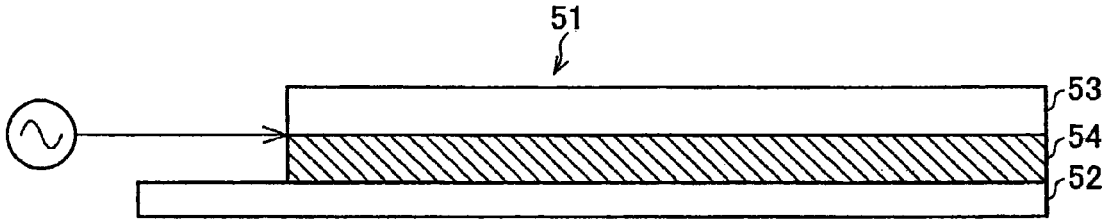
FIG. 11 PRIOR ART
FIG. 11 is a cross sectional view of a liquid crystal panel provided in a liquid crystal display device.
Figure 12:
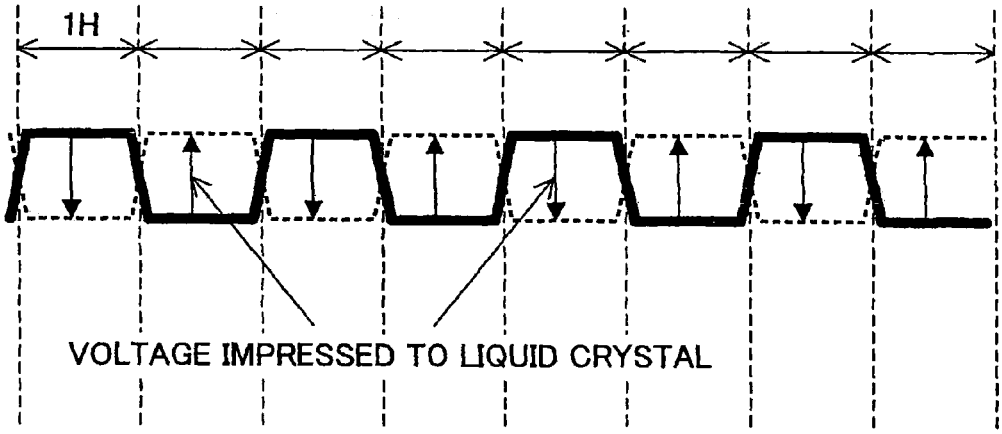
FIG. 12 PRIOR ART
FIG. 12 is a waveform chart showing a timing of driving pixel electrodes and counter electrodes, in a case where a line-inversion method is adopted for driving the liquid crystal display device.
Figure 13:
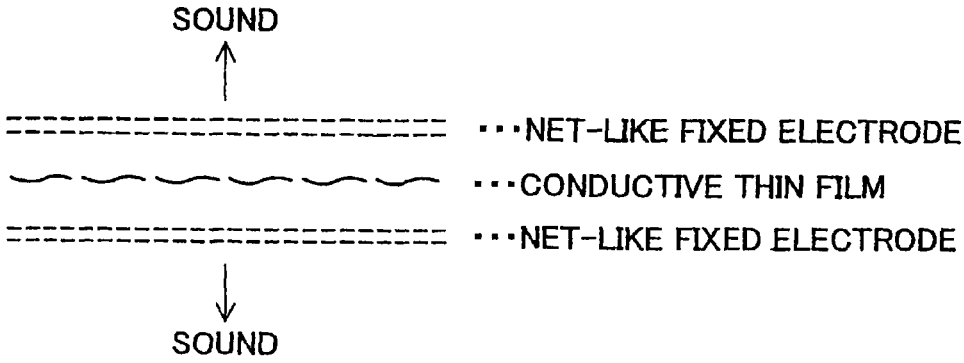
FIG. 13 PRIOR ART
FIG. 13 is a cross sectional view of an electrostatic speaker.

The following describes yet another embodiment of the present invention with reference to FIG. 9 to FIG. 10. It should be noted that the same symbols are given to the members that have the same functions as those shown in figures of the foregoing embodiments 1 and 2, and the descriptions of those members are omitted here as a matter of convenience.

A liquid crystal display device (Hereinafter referred to as LCD device) of the present embodiment includes a display control circuit 34 shown in FIG. 9, instead of the display control circuit 24 (FIG. 6) provided in the LCD device of the foregoing embodiment 2. FIG. 9 is a block diagram showing a configuration of the display control circuit 34 provided in the LCD device of the present embodiment.

As shown in FIG. 9, in order to, for example, generate driving signals for driving pixel electrodes, the display control circuit 34 includes an input control circuit 35, a TG (timing generator) 36, a memory control circuit 37, and a display memory (memory section) 38.

The input control circuit 35 is for sending a signal, which is inputted into the display control circuit 34, to the TG 36 or the display memory 38. A horizontal sync signal Hsync (Hereinafter referred to as Hsync), a vertical sync signal Vsync (Hereinafter referred to as Vsync), a clock signal Clock (Hereinafter referred to as Clock), a write-in permission signal Enable (Hereinafter referred to as Enable), and an RGB data signal DATA1 (Hereinafter referred to as DATA1) are respectively inputted as input signals into the input control circuit 35. The input control circuit 35 sends the DATA1 to the first display memory 38, and sends a signal group Dc including the Hsync, Vsync, Clock, and the Enable to the TG 36.

The TG 36 generates signals to be inputted into the display memory 38, a video signal line driving circuit 12, and a scan signal line driving circuit 13. The detailed configuration of the TG 36 is the same as TG 26 in FIG. 7, described in the foregoing embodiment 2, and detailed description of the TG 36 is omitted here. Note that, similarly to the foregoing embodiment 2, the driving signals generated by the TG 36 are outputted to the video signal driving circuit 12 and the scan signal line driving circuit 13, and are also outputted to the display memory 38 and the memory control circuit 37.

Note further that the signal group Dc inputted from the input control circuit 35 to the TG 36 is sent to the memory control circuit 37 via the TG 36. Further, the TG 36 outputs the Clock to the first display memory 38, when the Enable is set high. This causes the DATA1 to be stored in the first display memory 38, when the DATA1 is inputted.

The memory control circuit 37 controls (i) storing of the data signal DATA1 in the display memory 38, and (ii) reading out of a data signal DATA2 (Hereinafter referred to as DATA2).

The display memory 38 stores the DATA1 supplied from the input control circuit 35, and reads out the stored DATA1 as DATA2 at a predetermined timing. Then, the display memory 38 outputs the DATA2 to the video signal line driving circuit 12.

In the LCD device having the display control circuit 34 having the above-described configuration, a driving period and a drive suspension period are provided and a video signal is written in at a timing shown in FIG. 10. FIG. 10 is a waveform chart of driving waveform in the LCD device of the present invention, and indicates timing of driving in 1V period.

Input signals (i.e. the Hsync, Vsync, Clock, Enable, and the DATA1) are inputted into the input control circuit 25 of the display control circuit 24 shown in FIG. 6. Unlike the foregoing embodiment 1, frequencies of these input signals are not set high. More specifically, in order to prevent a noise from being produced from the LCD device, the frequencies of the input signals in the present embodiment are not set high accordingly to timing of counter electrode driving frequency that is set high.

Therefore, similarly to the foregoing embodiment 2, in the present embodiment, driving signals (i.e. the SSP, SCK, LS, GSP, GCK and DATA2) are generated with the respective frequencies thereof being set high in accordance with the counter electrode driving frequency, so that the DATA2 is written into each of the liquid crystal cells.

The SSP, SCK, LS, GSP, and GCK are respectively generated in the TG 36 as in the case of TG 26 described in the foregoing embodiment 2.

In the meanwhile, among the input signals inputted into the display control circuit 34, the DATA1 is sent from the input control circuit 35 to the display memory 38, and is stored in the display memory 38. Then, the memory control circuit 37 starts counting the Hsync at a falling timing of the Vsync. When the count value reaches to a predetermined value, the DATA1 stored in the display memory 38 is read out as the DATA2, and is outputted to the video signal line driving circuit 12.

Here, the DATA2 is outputted from the display memory 38 as in the case of the embodiment 2. More specifically, the memory control circuit 37 starts counting an internal clock signal generated by an internal oscillation circuit in the TG 36. This internal clock signal is the same as the internal clock signal described in the foregoing embodiment 2, and has higher frequency than the Clock that is the input signal. Then, every time the counter electrode voltage Vcom is inverted, the memory control circuit 37 resets the counting of the internal clock signal, thereby determining the timing of outputting the DATA1 inputted, i.e. the timing of the rising and falling of the DATA2. Through these operations of the memory control circuit 37, the DATA2 is outputted to the video signal line driving circuit 12 as shown in FIG. 10. The DATA2 is outputted from the display memory 38 in accordance with the internal clock signal whose frequency is set high and the counter electrode driving frequency f. Therefore, the frequency of the DATA2 is set high as shown in FIG. 10.

Incidentally, as shown in FIG. 10, in the present embodiment, the DATA1 continues to be inputted to the display control section 35, and is successively stored in the display memory 38, even while the DATA2 is being outputted to the video signal line driving circuit 12. Consequently, the DATA1 inputted while the DATA2 is being outputted is also successively outputted as the DATA2 to the video signal line driving circuit 12. In short, the DATA2 is read out from the display memory 38 while the DATA1 is written into the display memory 38. Thus, in the present embodiment, the DATA1 inputted in 1V period can be outputted as the DATA2 within the same vertical period, unlike the foregoing embodiment 2.

As described, in the present embodiment, the display memory 38 carries out the inputting of the DATA1 and the outputting of the DATA2 simultaneously. Therefore, it is preferable that the display memory 38 be a dual-gate memory. This allows the data signals stored in the beginning of 1V-period to be successively read out and be outputted as the DATA2.

Then, similarly to the foregoing embodiment 1, when the driving signals are outputted from the display control circuit 24 to the video signal line driving circuit 12 and the scan signal line driving circuit 13, the voltage is charged and retained in the liquid crystal cells, so that the image is displayed on the LC panel 11.

It should be noted that the display memory 38 of the present embodiment may have any capacity as long as the capacity is sufficient for simultaneously carrying out the inputting of the DATA1 and the outputting of the DATA2. In the present embodiment, it is possible to successively write the new DATA1 into a free area of the capacity created by successively outputting the DATA1, as the DATA2, from the display memory 38. Therefore, unlike first and second memories 28 and 29 of the foregoing embodiment 2, the capacity of the display memory does not have to be more than an amount of data equivalent to the image displayed within the 1V period.

The present invention is not limited to the embodiments above, but may be altered within the scope of the claims. An embodiment based on a proper combination of technical means disclosed in different embodiments is encompassed in the technical scope of the present invention.

As described, a driving method of the present invention for driving a liquid crystal display device includes the steps of (a) dividing one frame period, in which the one of the frames is displayed, into (i) a drive period in which the counter electrodes are driven and (ii) a drive suspension period in which the counter electrodes are not driven; (b) outputting, during the drive period, the image data to the driving circuit at a same frequency as a frequency for driving the counter electrodes; and (c) stopping outputting of the image data to the driving circuit during the drive suspension period.

Further, the foregoing driving method may be adapted so that input data has a frequency which is the same as the frequency for driving the counter electrodes, and the input data is inputted during the driving period.

In the foregoing method, the input data is inputted to the liquid crystal display device at a same time the counter electrode is driven, and a frequency of the input data is the same as the frequency for driving the counter electrodes. Accordingly, by determining the frequency of the input data and a timing of inputting the input data in advance, inputting of the input data into the liquid crystal display device can cause the image data to be outputted to the driving circuit at the same time the counter electrode is driven.

Further, the foregoing driving method is adapted so that the active matrix liquid crystal display device is provided with a memory section for storing the input data, and the image data is outputted to the driving circuit from the memory section during the drive period.

In the foregoing method, the memory section for temporarily storing the input data is provided. Accordingly, it is possible to generate the image data having a desirable frequency based on the input data inputted to the liquid crystal display device, and to output the image data to the driving circuit at a desirable timing. Accordingly, it is possible to output the image data at a desirable frequency and at a desirable timing, even though the frequency and timing on inputting the input signals are different from those on outputting the image data to the driving circuit.

Further, the foregoing driving method is adapted so that (a) the memory section includes at least a first memory section and a second memory section; (b) after the first memory stores a predetermined amount of the input data, the input data is forwarded to the second memory; (c) the image data is generated based on the input data forwarded to the second memory; and (d) the image data is outputted from the second memory to the driving circuit during the drive period.

In the foregoing method, the memory section includes two memory sections, i.e. the first and the second memory sections. This allows the image data to be outputted from the second memory section to the driving circuit, while the first memory section is storing therein the input data.

Further, the foregoing driving method may be adapted so that the memory section stores the input data during the drive period, and simultaneously outputs the image data to the driving circuit.

In the foregoing method, the single memory section can store therein the input data, and output the image data therefrom to the driving circuit at the same time. This allows reduction of the capacity of the memory section, thus realizing a size-reduced liquid crystal display device, and a cost reduction.

Further, as described, in a liquid crystal display device of the present invention, a display control section includes (a) a memory section for storing therein image data to be displayed on the displaying section, the image data represented by a signal of the input signals; and (b) a memory section control device for controlling timing of outputting the image data from the memory section to the driving circuit in accordance with a frequency for driving the counter electrode.

Further, the foregoing liquid crystal display device of the present invention may be adapted so that the memory section includes (a) a first memory section for storing therein a predetermined amount of the image data inputted to the display control section, and (b) a second memory section for outputting the predetermined amount of the image data, which has been forwarded from the first memory section, to the driving circuit in accordance with the frequency for driving the counter electrodes.

In the foregoing configuration, the memory section includes two memory sections, i.e. the first and the second memory sections. This allows the image data to be outputted from the second memory section to the driving circuit, while the first memory section is storing therein the input data.

Further, the foregoing liquid crystal display device of the present invention may be adapted so that the memory section outputs the image data to the driving circuit in accordance with the frequency for driving the counter electrodes, while the memory section is storing therein the image data inputted to the display control section.

In the foregoing configuration, the single memory section can store therein the input data, and output the image data therefrom to the driving circuit at the same time. This allows reduction of the capacity of the memory section, thus realizing a size-reduced liquid crystal display device, and a cost reduction.

Further, the foregoing liquid crystal display device of the present invention may be adapted so that the display control section further includes an internal oscillation circuit for generating a clock signal for use in determining timing of outputting the image data from the memory section to the driving circuit at the cycle corresponding to the frequency for driving the counter electrodes.

The foregoing configuration allows the image data at a desirable frequency to be outputted at a desirable timing, by utilizing the clock signal generated by the internal oscillation circuit. Thus, it is possible to (i) desirably determine the frequency of the image data and the timing of outputting the image data, based on the frequency of the input signals and the timing of inputting the input signals, and (ii) output the image data at the frequency matching with the frequency for driving the counter electrode at the timing synchronized with the timing of the frequency for driving the counter electrode.

A liquid crystal display device and driving device and display control device thereof in accordance with the present invention, as well as a driving method of the present invention for driving the liquid crystal display device can be applied to a display used in a mobile phone, digital camera, personal computer, liquid crystal television and so on. With the present invention, there is provided a liquid crystal display device in which user aggravating sound is prevented without increasing its power consumption.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A driving method for driving an active matrix liquid crystal display device provided with a memory section for storing input data, which is a signal being inputted from outside, during a vertical period, the active matrix liquid crystal display device for sequentially displaying frames of image on a display section including (A) scanning signal lines, (B) video signal lines, the scanning signal lines and video signal lines intersecting with each other on a single substrate, (C) pixel electrodes arranged in a grid-like region compartmentalized by the scanning signal lines and the video signal lines, (D) counter electrodes so arranged that the pixel electrodes and the counter electrodes face each other across a liquid crystal layer, the active matrix liquid crystal display device in which each of the frames is sequentially displayed by (I) driving the counter electrodes, (II) generating image data which corresponds to one of the frames, based on the input data, and (III) outputting the image data to a driving circuit by the memory section in a subsequent vertical period, the method comprising:

driving the counter electrodes at a frequency higher than a frequency within an audible frequency band for a human being;

dividing one frame period, in which the one of the frames is displayed, into (i) a drive period in which the counter electrodes are driven and (ii) a drive suspension period in which the counter electrodes are not driven, the image data being output to the driving circuit from the memory section during the drive period;

outputting from the memory section, in synchronization with the drive period, the image data to the driving circuit at a same frequency as a frequency for driving the counter electrodes and at a different frequency than a frequency of the input data being input, the outputted image data and the driving the counter electrodes being separate signals, and the drive period being the subsequent vertical period; and stopping outputting of the image data to the driving circuit during the drive suspension period.

2. The driving method as set forth in claim 1, wherein:

the memory section includes at least a first memory and a second memory;

after the first memory stores a predetermined amount of the input data, the input data is forwarded to the second memory;

the image data is generated based on the input data forwarded to the second memory; and the image data is outputted from the second memory to the driving circuit during the drive period.

3. The driving method as set forth in claim 1, wherein:

the memory section stores the input data during the drive period, and simultaneously outputs the image data to the driving circuit.

4. The method of claim 1, further comprising:

generating a timing of the drive period and drive suspension period based on outputs from a plurality of matching circuits.

5. The method of claim 1 wherein the drive period is approximately less than 8 ms.

6. A driving device for driving a display section comprising:

scanning signal lines;

video signal lines, the scanning signal lines and video signal lines intersecting with each other on a single substrate;

pixel electrodes arranged in a grid-like region compartmentalized by the scanning signal lines and the video signal lines;

counter electrodes so arranged that the pixel electrodes and the counter electrodes face each other across a liquid crystal layer, the driving device causing the display section to sequentially display frames of image; and a display control section for generating image data based on input data being inputted from outside, and for outputting the image data to a driving circuit, the driving circuit for controlling the displaying of an image on the display section based on the image data and the display control section having a memory section for (i) storing the input data in a vertical period and outputting the image data from the memory section to the driving circuit in synchronization with a part of one period for displaying one frame of image at a cycle corresponding to a driving frequency, the driving frequency being a different frequency than a frequency of the input data being input, and (ii) stopping outputting the image data to the driving circuit during a remaining part of the one period for displaying one frame of image wherein a driving voltage is outputted to the pixel electrodes and the counter electrodes during the part of the one period for displaying one frame of image, the pixel electrodes and counter electrodes having the same driving frequency, the driving frequency is higher than an audible frequency band for a human being, and the part of one period for displaying one frame of image is a subsequent vertical period, and the driving voltage is not supplied to the pixel electrodes and the counter electrodes, during the remaining part of the one period for displaying the one frame of image, the driving voltage and the outputted image data being separate signals.

* * * * *